US009070528B2

(12) United States Patent
Kim et al.

(10) Patent No.: US 9,070,528 B2
(45) Date of Patent: Jun. 30, 2015

(54) X-RAY GENERATOR AND X-RAY PHOTOGRAPHING APPARATUS

(75) Inventors: Ki-yeo Kim, Gyeonggi-do (KR); Min-kook Cho, Busan (KR); Byung-sun Choi, Gyenoggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 288 days.

(21) Appl. No.: 13/463,351

(22) Filed: May 3, 2012

(65) Prior Publication Data

US 2013/0121462 A1 May 16, 2013

(30) Foreign Application Priority Data

Nov. 15, 2011 (KR) ..... 10-2011-0119128

(51) Int. Cl.
*H01J 35/14* (2006.01)
*H01J 35/06* (2006.01)
*H01J 35/24* (2006.01)

(52) U.S. Cl.
CPC ..... *H01J 35/06* (2013.01); *H01J 35/14* (2013.01); *H01J 2235/086* (2013.01); *H01J 2235/087* (2013.01); *H01J 35/24* (2013.01)

(58) Field of Classification Search
CPC ..... H01J 35/14; H01J 35/30; H01J 35/06
USPC ..... 378/137–138
See application file for complete search history.

(56) References Cited

U.S. PATENT DOCUMENTS

| | | | | |
|---|---|---|---|---|
| 4,135,095 | A * | 1/1979 | Watanabe | 378/113 |
| 5,511,105 | A * | 4/1996 | Knott | 378/134 |
| 6,333,968 | B1 * | 12/2001 | Whitlock et al. | 378/136 |
| 6,778,633 | B1 * | 8/2004 | Loxley et al. | 378/113 |
| 7,403,595 | B2 * | 7/2008 | Kim et al. | 378/122 |
| 7,715,529 | B1 | 5/2010 | Lee et al. | |
| 2006/0018432 | A1 * | 1/2006 | Zhou et al. | 378/122 |

FOREIGN PATENT DOCUMENTS

| | | | |
|---|---|---|---|
| KR | 10-2008-0103286 | A | 11/2008 |
| KR | 10-2009-0078243 | A | 7/2009 |
| KR | 10-2010-0090078 | A | 8/2010 |

* cited by examiner

*Primary Examiner* — Hoon Song
(74) *Attorney, Agent, or Firm* — Cha & Reiter, LLC.

(57) ABSTRACT

An X-ray generator and an X-ray photographing apparatus including the X-ray generator generate characteristic X-rays. The X-ray generator includes an electron beam emission unit that emits electron beams; an electron beam guide unit, in which the electron beam emission unit is disposed, for condensing the electron beams and causing the electron beams to travel in a predetermined direction; and a target unit disposed to face the electron beam guide unit, and discharging X-rays when the electron beams collide with the target unit.

25 Claims, 7 Drawing Sheets

X-RAY GENERATOR AND X-RAY PHOTOGRAPHING APPARATUS

CLAIM OF PRIORITY

This application claims, pursuant to 35 U.S.C. §119(a), priority to and the benefit of the earlier filing date of Korean Patent Application No. 10-2011-0119128, filed on Nov. 15, 2011, in the Korean Intellectual Property Office, the disclosure of which is incorporated herein in its entirety by reference.

BACKGROUND OF THE INVENTION

1. Field of the Invention

The present invention relates to an X-ray generator emitting characteristic X-rays and an X-ray photographing apparatus including the X-ray generator.

2. Description of the Related Art

X-rays are used to perform non-destructive inspection, structural and physical property inspection of a material, image diagnosis, and security searching in the fields of industry, science, and medical treatment. In general, a photographing apparatus using X-rays includes an X-ray generator emitting the X-rays, and a detecting unit for detecting the X-rays that pass through an object.

Here, the X-ray generator generates the X-rays by generally generating electron beams emitted from an anode and colliding such electron beams with a cathode. The X-rays may be composed of Bremsstrahlung X-rays that are emitted mainly by deceleration of the electron beams, and characteristic X-rays emitted from an energy level of a target material.

The Bremsstrahlung X-rays represent a wide range spectrum, and thus may be referred to as polychromatic X-rays. Therefore, when the Bremsstrahlung X-rays are used, an X-ray image is produced, in which absorption coefficients of the material are mixed, and thus, contrast characteristics of the polychromatic X-ray image are degraded when the polychromatic X-ray image is compared with an image produced when the characteristic X-rays, which are monochromatic X-rays, are used. Thus, it is difficult to distinguish materials from each other in the target when using polychromatic X-ray imaging.

In addition, when the Bremsstrahlung X-rays are projected onto a human body, they are mostly absorbed by the human body, thus increasing the amount of radiation exposure to the human body. Therefore, a filter formed of aluminum or copper is generally disposed to remove the X-rays of a low level energy region and thus to prevent exposure of the human body to such low level energy X-rays, when imaging diagnosis is performed.

Therefore, research regarding the use of characteristic X-rays to obtain a high quality X-ray image or to perform the imaging diagnosis is being conducted, since there is a need to obtain such high quality X-ray images while minimizing exposure of a target, such as the human body, to the X-rays.

SUMMARY OF THE INVENTION

The present invention provides an X-ray generator that emits characteristic X-rays and an X-ray photographing apparatus including the X-ray generator.

According to an aspect of the present invention, there is provided an X-ray generator including: an electron beam emission unit that emits electron beams; an electron beam guide unit, in which the electron beam emission unit is disposed, for condensing the electron beams and making the electron beams proceed in a predetermined direction; and a target unit disposed to face the electron beam guide unit, and discharging X-rays when the electron beams collide with the target unit.

The target unit may be disposed perpendicularly to a proceeding direction of the electron beam.

The electron beam guide unit may include: an electron beam collecting unit, in which the electron beam emission unit is disposed, for collecting the electron beams emitted from the electron beam emission unit; an electron beam condensing unit for condensing the electron beams; and an electron beam incident unit for making the condensed electron beam incident into the target unit.

The electron beam collecting unit, the electron beam condensing unit, and the electron beam incident unit may be sequentially arranged from a side of the electron beam emission unit toward a side of the target unit.

At least one of the electron beam collecting unit, the electron beam condensing unit, and the electron beam incident unit may be separate and independent components.

A cross-sectional area of the electron beam collecting unit may be greater than a cross-sectional area of the electron beam incident unit.

A cross-sectional area of the electron beam condensing unit may be reduced gradually from a side of the electron beam collecting unit to a side of the electron beam incident unit.

The electron beam incident unit may be disposed to face the target unit.

Voltages applied to the electron beam collecting unit, the electron beam condensing unit, and the electron beam incident unit may be different from each other.

The voltage applied to the electron beam incident unit may be greater than the voltages applied to the electron beam collecting unit and the electron beam condensing unit.

The electron beam emission unit may be a filament forming an opening.

The target unit may be rotatable.

The target unit may discharge a plurality of characteristic X-rays having different spectrums from each other.

The plurality of characteristic X-rays may be sequentially discharged one by one.

The target unit may include a plurality of target areas that are formed of different atoms from each other, and may further include: a target holder supporting the target unit; and a target driving unit for moving the target holder so that the plurality of target areas may be selectively located in the proceeding direction of the electron beam.

The plurality of target areas may be arranged as a circle on the target holder, and the target driving unit may rotate or move the target holder in a pendulum motion.

According to another aspect of the present invention, there is provided an X-ray photographing apparatus including: an X-ray generator described above; and an X-ray detector for detecting the X-ray that is discharged from the X-ray generator to pass through an object.

The X-ray detector may be disposed on a same line as a proceeding direction of the electron beam that is incident into the target unit.

The electron beam emission unit may be disposed between the target unit and the X-ray detector.

The electron beam guide unit may include an opening.

The target unit may be disposed between the electron beam emission unit and the X-ray detector.

The X-ray detector may detect characteristic X-rays.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
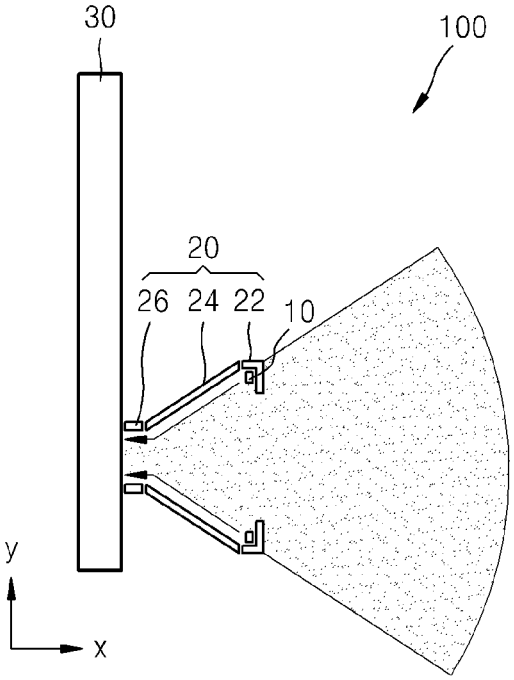
FIG. 1 is a schematic cross-sectional view of an X-ray generator according to an exemplary embodiment of the present invention.

Hereinafter, the present invention will be described in detail by explaining preferred embodiments of the invention with reference to the attached drawings. Like reference numerals in the drawings denote like elements. This invention may, however, be embodied in many different forms and should not be construed as limited to the exemplary embodiments set forth herein. In the following description, a detailed explanation of known related functions and constructions may be omitted to avoid unnecessarily obscuring the subject matter of the present invention. Also, terms described herein, which are defined considering the functions of the present invention, may be implemented differently depending on user and operator's intention and practice. Therefore, the terms should be understood on the basis of the disclosure throughout the specification. The principles and features of this invention may be employed in varied and numerous embodiments without departing from the scope of the invention.

Furthermore, although the drawings represent exemplary embodiments of the invention, the drawings are not necessarily to scale and certain features may be exaggerated or omitted in order to more clearly illustrate and explain the present invention.

Expressions such as "at least one of," when preceding a list of elements, modify the entire list of elements and do not modify the individual elements of the list.

Figure 2:
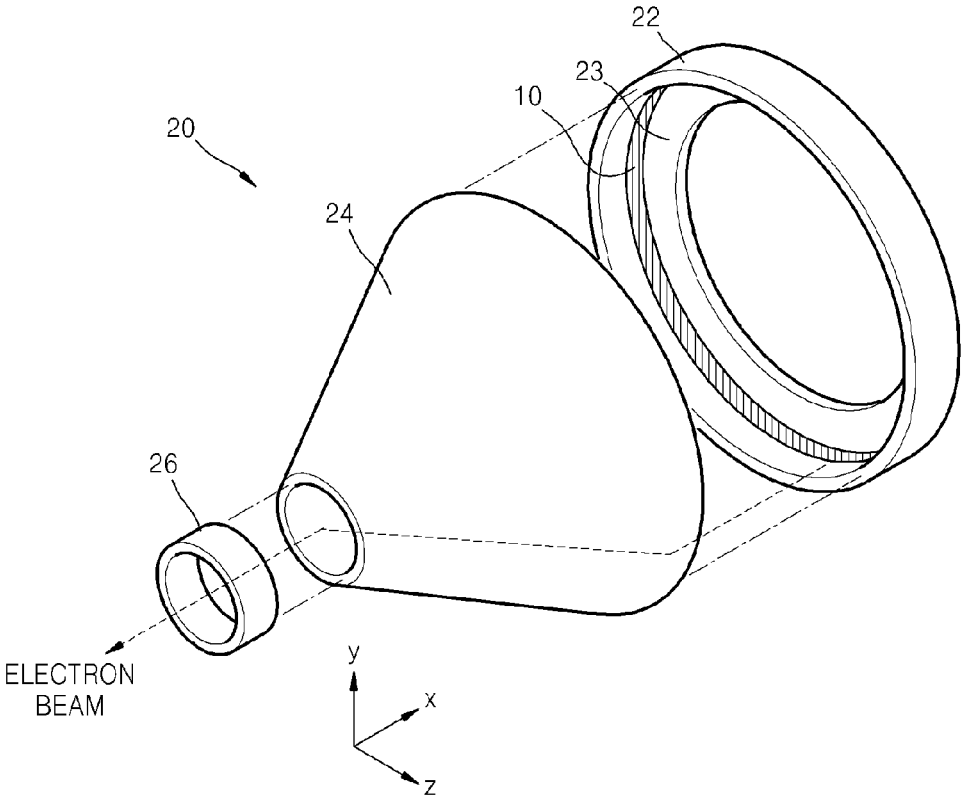
FIG. 2 is a perspective view of an electron beam guide unit of the X-ray generator of FIG. 1.

FIG. 1 is a schematic cross-sectional view of an X-ray generator 100 according to an exemplary embodiment of the present invention, with the cross-sectional view oriented in the x-y plane, as shown in FIGS. 1-2. Referring to FIG. 1, the X-ray generator 100 includes an electron beam emission unit 10 that emits electron beams, an electron beam guide unit 20 including the electron beam emission unit 10 therein, with the electron beam unit 20 condensing the electron beams to cause the electron beams to travel in a predetermined direction such as generally parallel to the x-axis shown in FIG. 1, and a target unit 30 facing an end of the electron beam guide unit 20 and emitting X-rays caused by collision of the electron beams with the target unit 30.

The electron beam emission unit 10 generates and emits the electron beams. The electron beam emission unit 10 may include a filament that is formed by using coils composed of, for example, tungsten. When an electric current flows through the filament, the filament is heated and the heated filament discharges the electron beams omni-directionally. Instead of or in addition to the filament, in alternative embodiments, the electron beam emission unit 10 may include a photocathode that may emit the electron beams, and/or an electron beam emission device of a field emission type. In addition, the electron beam emission unit 10 may include a carbon nano-generator. When the carbon nano-generator is used, the electron beams may be discharged at room temperature, and thus, a lifespan of the X-ray source is greatly increased. In addition, an efficiency of discharging the electron beams is superior when a carbon nano-generator is used, and thus, the X-rays may be emitted at a relatively high luminance and high efficiency. The electron beam emitted from the electron beam emission unit 10 is accelerated while traveling generally parallel to the x-axis toward the target unit 30, and thus, the velocity of the electron beam is sufficiently high to emit an X-ray when colliding with the target unit 30.

FIG. 2 is a perspective view of the electron beam guide unit 20 of the X-ray generator 100 of FIG. 1, according to the exemplary embodiment of the present invention, with parts separated for clarity. When the electron beam emission unit 10 emits the electron beams omni-directionally, the electron beam emission unit 10 may include an opening through which the electron beams may be transmitted. For example, if the electron beam emission unit 10 includes a filament, the filament emits the electron beams omni-directionally. In order to collect the emitted electron beams and to cause the electron beams to travel in a predetermined direction; that is, towards the target unit 30, the electron beams emitted in various directions, including an opposite direction to the predetermined direction, pass through the opening and proceed in the predetermined direction generally parallel to the x-axis toward the target unit 30. Therefore, a center axis of the opening may be parallel to the predetermined direction; that is, parallel to the x-axis. In order to form the opening, the electron beam emission unit 10 may be formed as a ring having an empty center portion. Otherwise, the electron beam emission unit 10 may be formed by combining a plurality of ring shapes. The ring may be a circular ring or a polygonal ring with cross-sections parallel to the y-z plane, or alternatively may be a ring with an irregular cross-section parallel to the y-z plane, as shown in FIG. 2. Alternatively, when the electron beam emission unit 10 emits the electron beams substantially in the predetermined direction, the opening may not be necessary.

The electron beam guide unit 20 guides the electron beams emitted from the electron beam emission unit 10 so that the electron beams may be incident into a target area of the target unit 30. The target unit 30 is disposed and oriented perpendicularly to the direction of travel of a substantial number of the electron beams. Here, the perpendicular direction not only denotes an accurate right angle according to its mathematical meaning, but also includes a substantial right angle including errors that arise from installation and fabrication of the X-ray generator. That is, the target unit 30 has at least a surface oriented parallel to the y-z plane shown in FIG. 2, which receives the electron beams traveling generally parallel to the x-axis and toward the target unit 30. Thus, the electron beams may be incident substantially perpendicularly into the target area of the target unit 30. The electron beam guide unit 20 may be formed as a shell including a path, through which the electron beams may be transmitted therein.

As shown in FIG. 2, the electron beam guide unit 20 includes an electron beam collecting unit 22 that collects the electron beams emitted from the electron beam emission unit 10, an electron beam condensing unit 24 that condenses the collected electron beams, and an electron beam incident unit 26 that directs the electron beams to be incident into the target unit 30. The electron beam collecting unit 22, the electron beam condensing unit 24, and the electron beam incident unit 26 may be sequentially arranged along the x-axis from the electron beam emission unit 10 to the target unit 30, as shown in FIGS. 1-2. In addition, the electron beam collecting unit 22, the electron beam condensing unit 24, and the electron beam incident unit 26 may be separate and independent components, assembled together. In alternative embodiments, at least a pair of such components 22, 24, and 26 may be fabricated as a monolithic or integral component. However, for the purpose of clarity of discussion, the exemplary embodiment having separate and independently fabricated components 22, 24, and 26 are described herein.

In greater detail shown in FIG. 2, the electron beam emission unit 10 may be disposed within the electron beam collecting unit 22. In addition, the electron beam collecting unit 22 collects the electron beams emitted from the electron beam emission unit 10. The electron beam collecting unit 22 may be formed as a cylinder, and the electron beam emission unit 10 may be disposed on an inner side end portion of the electron beam collecting unit 22. In addition, an electron beam shielding unit 23 is provided which blocks the electron beams from being discharged in an opposite direction along the x-axis away from the target unit 30, with the electron beam shielding unit disposed on one end of the electron beam collecting unit 22, and the other end of the electron beam collecting unit 22 may face the electron beam condensing unit 24. As shown in FIG. 2, the electron beam emission unit 10 is disposed between the electron beam shielding unit 23 and the electron beam condensing unit 24. The electron beam shielding unit 23 may be formed as a flat plate, and, in particular, may be formed as a ring-shaped flat plate including an opening, or alternatively as a flat plate having no opening. In the exemplary embodiment, the electron beam shielding unit 23 shown in FIG. 2 is formed as a ring-shaped flat plate having an annular portion substantially parallel to the y-z plane. However, the present invention is not limited thereto, and different and alternative configurations known in the art for the electron beam shielding unit 23 may be used.

The electron beam condensing unit 24 condenses the electron beams emitted from the electron beam emission unit 10. The electron beam condensing unit 24 may be formed as a circular truncated cone with a conical axis parallel to the x-axis, and having an empty inner space so that electrons may proceed therein. In addition, one end of the electron beam condensing unit 24 faces the other end of the electron beam collecting unit 22, and the other end of the electron beam condensing unit 24 may face an end of the electron beam incident unit 26. In the exemplary embodiment, the electron beam condensing unit 24 tapers along the x-axis toward the electron beam incident unit 26 and the target unit 30, such that the cross-sectional area of the electron beam condensing unit 24 substantially parallel to the y-z plane may be reduced gradually from a side of the electron beam emission unit 22 toward a side of the target unit 30, with the cross-sections being oriented to be substantially parallel to the y-z plane and also parallel to the generally planar surface of the target unit 30, shown in FIG. 1. For example, the cross-sectional area at an end of the electron beam condensing unit 24 may correspond to a cross-sectional area of the electron beam collecting unit 22 in the y-z plane, and the cross-sectional area at the other end of the electron beam condensing unit 24 may correspond to the cross-sectional area of the electron beam incident unit 26 in the y-z plane. In FIG. 2, the cross-sectional area of the electron beam condensing unit 24 in the y-z plane is continuously reduced from the side of the electron beam emission unit 10 toward the side of the target unit 30; however, the present invention is not limited thereto. That is, the cross-sectional area of the electron beam condensing unit 24 in the y-z plane may be reduced discontinuously. In addition, the cross-section of the electron beam condensing unit 24 shown in FIG. 2, which is oriented to be substantially parallel to the y-z plane, is a circular shape; however, the present invention is not limited thereto, that is, the cross-section of the electron beam condensing unit 24 may have a polygonal or an irregular shape in cross-sections substantially parallel to the y-z plane.

The electron beam incident unit 26 causes the condensed electron beams to be incident into the target unit 30. One end of the electron beam incident unit 26 faces the other end of the electron beam condensing unit 24, and the other end of the electron beam incident unit 26 may face the target unit 30. In particular, the electron beam incident unit 26 may be disposed in parallel to the target unit 30. That is, a cross-section of the electron beam incident unit 26 at its other end and the generally planar surface of the target unit 30 may be substantially parallel with each other, and in turn substantially parallel to the y-z plane, taking into consideration fabrication, implementation, and installation errors. When the other end of the electron beam incident unit 26 faces the target unit 30 in parallel with the generally planar surface of the target unit 30, shown in FIG. 1, the electron beams output from the electron beam incident unit 26 may be incident along the x-axis perpendicularly into the target unit 30. In addition, when the electron beams are incident along the x-axis perpendicularly into the target unit 30, a radiation type of the X-rays discharged from the target unit 30 may be easily predicted. In FIG. 2, the cross-section of the electron beam incident unit 26, substantially parallel to the y-z plane, has a circular shape; however, the present invention is not limited thereto, that is, the electron beam incident unit 26 may have a polygonal or irregular cross-section substantially parallel to the y-z plane.

Since the electron beam guide unit 20 not only prevents the electron beams from discharging outward along the x-axis direction away from the target unit 30, but also controls the direction of travel of the electron beams, the electron beam guide unit 20 may alternatively include an electronic lens. In addition, the electron beam guide unit 20 may be formed of an electrode or a coil. Thus, the electron beam guide unit 20 controls the movement of the electron beams by using an electric field or a magnetic field. In particular, when the electron beam guide unit 20 includes an electrode, voltages applied to the electron beam collecting unit 22, the electron beam condensing unit 24, and the electron beam incident unit 26 may be different from each other, with such voltages providing operating voltages to such units 22, 24, 26. For example, the voltages applied to the electron beam collecting unit 22, the electron beam condensing unit 24, and the electron beam incident unit 26 may be in an increasing numerical progression. As described above, when the voltages are applied to the electron beam guide unit 20, the electron beams are generated which may be incident into the target unit 30 at a high speed even when the electric current supplied to the electron beam emission unit 10 is not increased.

The electron beam guide unit 20 may include a conductive material such as a metal, a conductive polymer, or a conductive oxide material. For example, the electron beam guide unit 20 may be composed of Cu, Al, Au, Ag, Cr, Ni, Mo, Ti, Pt, or an alloy thereof, may be formed of thiophene or Poly(3,4-ethylenedioxythiophene) (PEDOT), and may be formed of $TiO_2$ or $IrO_x$.

In the exemplary embodiment of the present invention, as described herein, the electron beam collecting unit 22, the electron beam condensing unit 24, and the electron beam incident unit 26 of the electrode beam guide unit 20 are separate and independent components; however, the present invention is not limited thereto. For example, at least two of the electron beam collecting unit 22, the electron beam condensing unit 24, and the electron beam incident unit 26 may be integrally formed and/or fabricated together.

As described above, since the electron beam guide unit 20 condenses the electron beams emitted from the electron beam emission unit 10 and causes the electron beams to be incident into the target unit 30, a large amount of electron beams may be incident into the target unit 30 to generate a large amount of X-rays.

On the other hand, the target unit 30 discharges the X-rays when the electron beams collide with the target unit 30. The target unit 30 may be formed of a metal material such as copper, molybdenum, tungsten, or aluminum that may discharge the X-rays. The X-rays discharged from the target unit 30 may include at least one of a Bremsstrahlung X-ray and a characteristic X-ray. Here, the characteristic X-ray is discharged due to an energy difference when an electron included in an inner layer portion of an atom is discharged and then another electron enters into the inner layer portion, from where the first electron was discharged. Accordingly, the characteristic X-ray is composed of line spectrums of each atom's own line spectrum or a part thereof. Therefore, the target unit 30 may discharge an exclusive characteristic X-ray corresponding to the atoms according to the kind of atoms included in the composition of the target unit 30.

The X-ray generator 100 may further include a target driving unit (not shown) that drives or moves the target unit 30 so as to change a target area of the target unit 30. When the electron beams are incident into a certain region of the target unit 30, the target unit 30 may become heated, and thus, the operational lifespan of the X-ray generator 100 may be reduced. Therefore, the target driving unit moves the target unit 30, and thus moves the regions of incidence of the electron beams onto the target unit 30, so that the electron beams may be evenly incident into the surface of the target unit 30. For example, when the target unit 30 is formed as a disc shape, as described herein, the target driving unit may rotate the target unit 30, with the electron beam guide unit 20 being offset from the center of the disc shaped target unit to direct the incident electron beams into target areas of the target unit which are radially displaced from the center of the disc shaped target unit 30.

On the other hand, the target unit 30 may be formed of a substantially uniform composition of a metal material so that a particular kind of characteristic X-ray may be discharged. Otherwise, the target unit 30 may be formed of a plurality of metal materials or other known materials, so that a plurality of characteristic X-rays having different spectrums may be discharged to analyze an object precisely.

Figure 3:
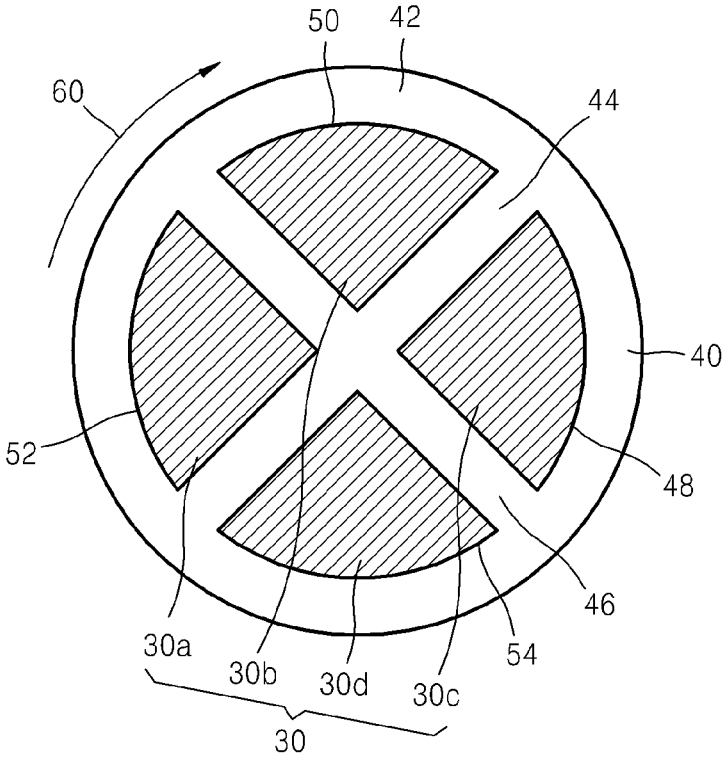
FIG. 3 is a front view of a target portion of the X-ray generator of FIG. 1, for emitting a plurality of characteristic X-rays according to the exemplary embodiment of the present invention.

FIG. 3 is a front view of the target unit 30 of the X-ray generator 100, which discharges a plurality of characteristic X-rays according to the exemplary embodiment of the present invention. As shown in FIG. 3, the target holder 40 may have a generally circular shape with a frame 42 and members 44, 46 forming windows 48, 50, 52, 54. The target unit 30 of the X-ray generator 100 according to the present embodiment may include a plurality of target areas 30*a*, 30*b*, 30*c*, and 30*d* having surfaces exposed through the windows 48, 50, 52, 54, of the target holder 40. The target areas 30*a*, 30*b*, 30*c*, 30*d* may be composed of a plurality of different metals (for example, W, Mo, Cu, and Ta) that discharge the characteristic X-rays having different wavelengths and spectrums as each of the target areas 30*a*, 30*b*, 30*c*, 30*d* are exposed to the electron beams as the target unit 30 is rotated, as described herein. In addition, the plurality of target areas 30*a*, 30*b*, 30*c*, and 30*d* are arranged in a circular shape so that the plurality of target areas 30*a*, 30*b*, 30*c*, and 30*d* may be selectively moved to be incident to the electron beam path due to rotation of the target holder 40, for example, in a clockwise direction represented by the arrow 60 shown in FIG. 3.

As shown in the exemplary embodiment of FIG. 3, a target holder 40 supports the target unit 30 and its target areas 30*a*, 30*b*, 30*c*, 30*d*, such that the target areas 30*a*, 30*b*, 30*c*, and 30*d* are exposed to the incident electron beams. In the exemplary embodiment, the target unit 30 may be fixed on the target holder 40. In addition, the target holder 40 may be formed of a material (for example, Be, Zr, or Al) that does not affect the characteristic X-rays discharged from the target unit 30. The target driving unit (not shown) moves each target area 30*a*, 30*b*, 30*c*, 30*d* to be in the path of the direction of travel of the electron beams so that the electron beams may selectively collide with one of the plurality of target areas 30*a*, 30*b*, 30*c*, and 30*d*. To do this, the target driving unit moves the target holder 40 on which the target unit 30 is fixed. In the exemplary embodiment shown in FIG. 3, a target driving unit rotates the target unit 30 in a clockwise direction 60.

Accordingly, the characteristic X-rays may be discharged selectively or sequentially. When the target driving unit rotates the target holder 40, the plurality of characteristic X-rays are sequentially discharged as each of the target areas 30*a*, 30*b*, 30*c*, 30*d* are exposed to the electron beams, and so characteristic X-rays are sequentially generated and discharged one by one. In an alternative embodiment, when the target driving unit moves the target holder 40 on an arm (not shown) by a certain angle (for example, by 90°) about a pivot point in a pendulum motion, only one characteristic X-ray is discharged. For example, the target holder 40 may be mounted on an arm, which swings about a pivot point to swing in a pendulum motion through the angle. The target holder 40 rotates or moves in the pendulum motion according to the kind or type of X-ray to be discharged.

The structure of the X-ray generator 100 is described as above. Hereinafter, an X-ray photographing apparatus 1000 including the X-ray generator 100 will be described.

Figure 4:
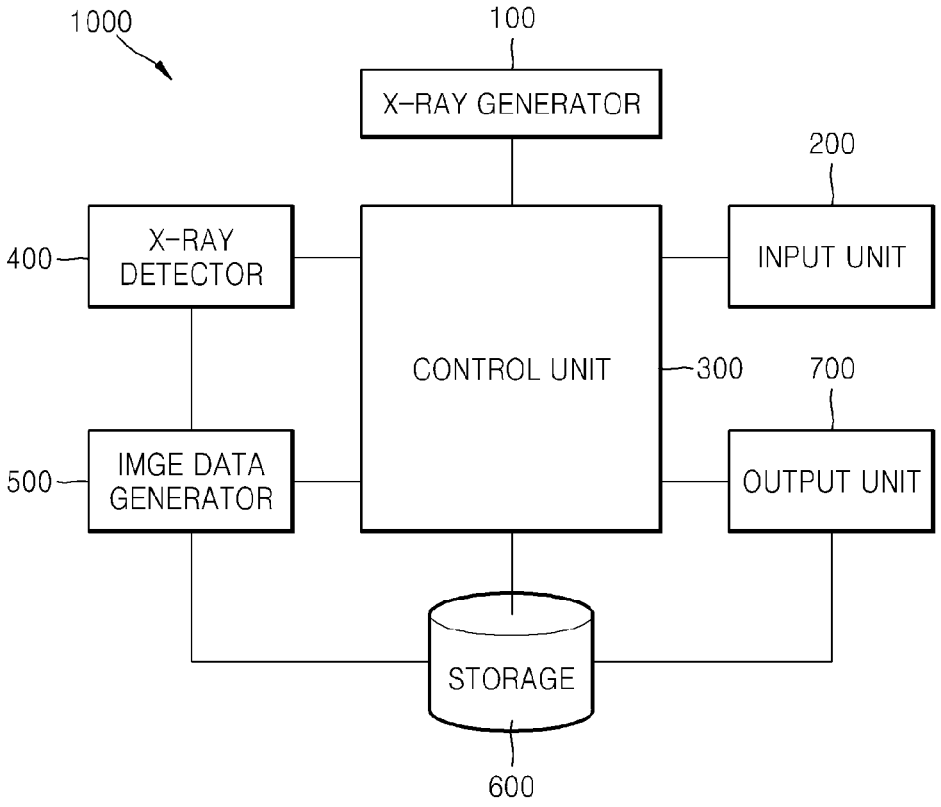
FIG. 4 is a block diagram of an X-ray photographing apparatus according to the exemplary embodiment of the present invention.

FIG. 4 is a block diagram of the X-ray photographing apparatus 1000 according to the exemplary embodiment of the present invention.

The X-ray photographing apparatus 1000 includes the X-ray generator 100, an input unit 200, a control unit 300, an X-ray detector 400, an image data generator 500, a storage 600, and an output unit 700.

The X-ray generator 100 discharges X-rays to an object as described above. In the exemplary embodiment, the X-ray is discharged at appropriate times at an appropriate dosage in consideration of the radiation amount of the X-rays to be delivered to the object, such as a human subject, including a patient. Otherwise, different kinds of characteristic X-rays may be discharged according to the object.

The input unit 200 receives a command for an X-ray photographing operation from a user such as a medical expert. Information about a command for changing a location and direction of X-ray emissions of the X-ray generator 100, a command for discharging the X-ray, a command for adjusting a parameter in order to change the spectrum of the X-ray, a command for rotating the body of the X-ray photographing apparatus 1000 or the X-ray generator 100, and commands input from the user is transferred to the control unit 300. The control unit 300 controls the components in the X-ray photographing apparatus 1000 according to an input command of the user.

The X-ray detector 400 detects the X-ray that has passed through the object. The X-ray detector 400 may detect the characteristic X-ray. Whenever the X-ray generator 100 discharges the X-ray, the X-ray detector 400 detects the X-ray that has passed through the object and reached the X-ray detector 400. The X-ray detector 400 may be formed of a combination of a plurality of cells, each of which senses or otherwise detects the X-rays. In addition, the X-ray signal sensed by each of the cells is converted into an electric signal by the sensing cell. A flat panel detector may be used as the X-ray detector 400. The image data generator 500 receives the electric signal corresponding to the X-ray detected by the X-ray detector 400. The image data generator 500 generates digital data including information about a cross-section in the object from the received electric signal. The generated data is data about the cross-section in the object, and thus, is referred to as cross-section data. Once the X-ray is discharged, a single set of cross-section data including information about the cross-section of the object is generated. When the X-ray generator 100 discharges the X-rays a plurality of times while changing the position thereof, a plurality of sets of cross-section data, including information about different cross-sections of the object, is generated. When the plurality of cross-section data, including adjacent cross-sections, are accumulated, three-dimensional volume data showing the object three-dimensionally may be obtained.

The storage 600 includes at least one memory device and stores the cross-section data generated by the image data generator 500. In addition, the storage 600 also stores the three-dimensional volume data generated by the image data generator 500. The storage 600 transmits the stored cross-section data or the three-dimensional volume data to the output unit 700 according to a request of the user.

As described above, the X-rays discharged from the target unit 30 may include Bremsstrahlung X-rays and characteristic X-rays. The Bremsstrahlung X-rays and the characteristic X-rays may have different radiation types.

Figure 5:
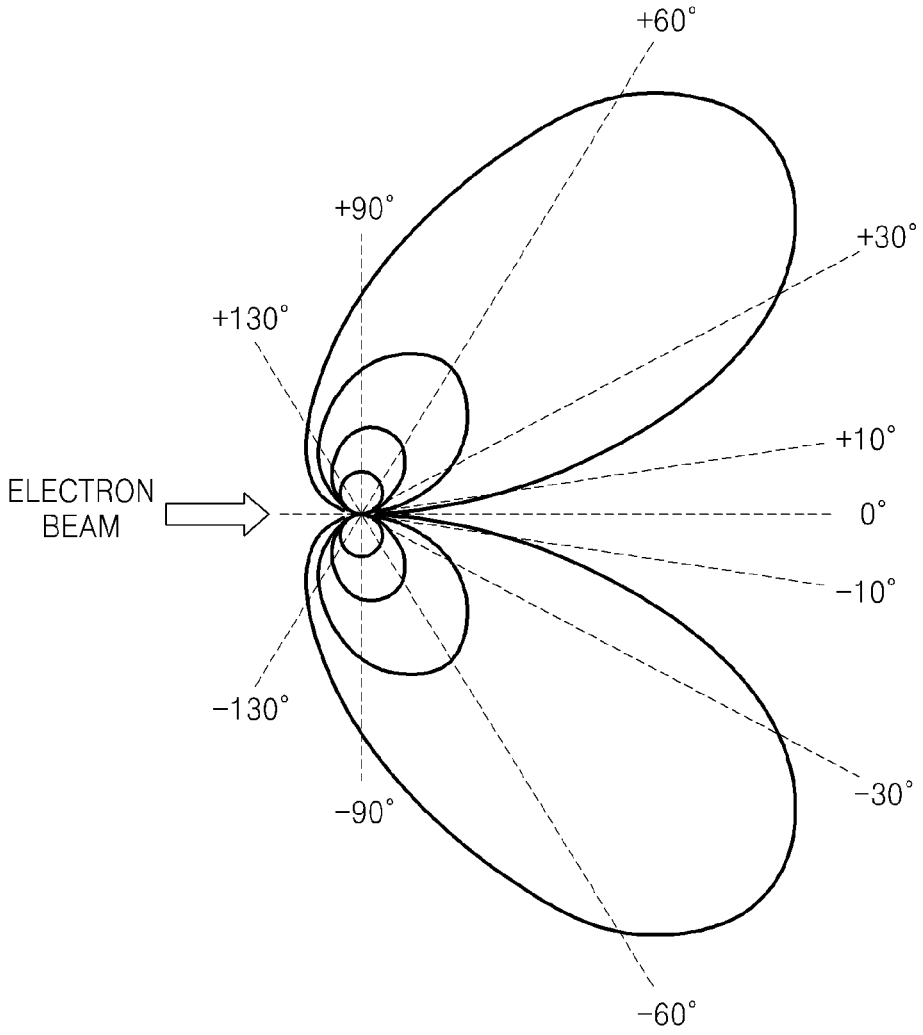
FIG. 5 is a diagram showing a spatial distribution of Bremsstrahlung X-rays.

FIG. 5 is a diagram showing a spatial distribution of Bremsstrahlung X-rays when the electron beams collide with the target unit 30, with the electron beam traveling in the direction indicated by the arrow in FIG. 5. The travel direction is also referred to herein as the incident direction, which is the direction in which the electron beam is incident into the target unit 30. Referring to FIG. 5, the distribution of Bremsstrahlung X-rays is greatly reduced in the direction of travel of the electron beam or in an opposite direction to the travel direction. However, a characteristic X-ray may be distributed in a constant direction, such as parallel with the direction of travel of the electron beam. Therefore, when the X-ray detector 400 is disposed in the direction of travel of the electron beams that are incident into the target unit 30, such as along the x-axis shown in FIGS. 1-2, the characteristic X-ray may be detected easily without interference from the generated Bremsstrahlung X-rays.

Figure 6:
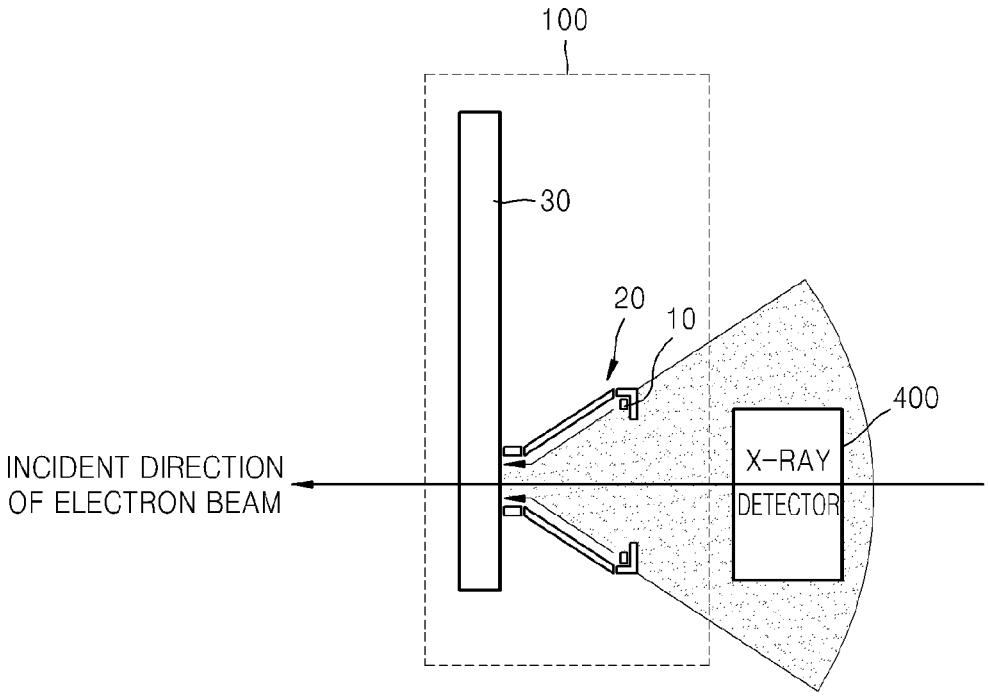
FIG. 6 is a diagram showing an arrangement of an X-ray generator and an X-ray detector according to the exemplary embodiment of the present invention.

FIG. 6 is a diagram showing a relation between arrangements of the X-ray generator 100 and the X-ray detector 400 according to the exemplary embodiment of the present invention.

As shown in FIG. 6, the X-ray detector 400 may have a detection area oriented to face the target unit 30 while the electron beam emission unit 10 is disposed between the X-ray detector 400 and the target unit 30. Since the distribution of Bremsstrahlung X-rays is greatly reduced in the incident direction of the electron beam and the opposite direction to the incident direction, with the incident direction being the travel direction of the generated X-rays, the X-ray detector 400 may easily detect a characteristic X-ray without interference from the generated Bremsstrahlung X-rays. In addition, the electron beam emission unit 10 has an opening through which the generated X-ray passes, and the electron beam guide unit 20 has the configuration of a shell, and thus, the X-ray may travel without any interference and is detected by the X-ray detector 400.

Figure 7:
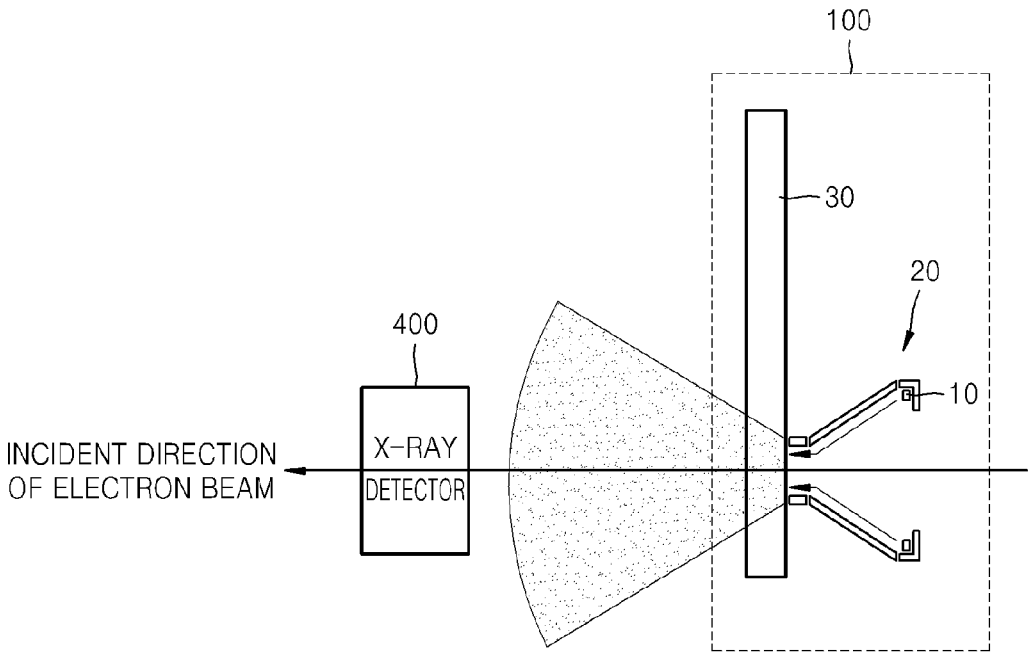
FIG. 7 is a diagram showing an arrangement of an X-ray generator and an X-ray detector according to another exemplary embodiment of the present invention.

FIG. 7 is a diagram showing a relation between arrangements of the X-ray generator 100 and the X-ray detector 400 according to another exemplary embodiment of the present invention.

As shown in FIG. 7, the X-ray detector 400 may have a detection area oriented to face the electron beam emission unit 10 while the target unit 30 is disposed between the X-ray detector 400 and the target unit 30. Since the distribution of Bremsstrahlung X-rays is greatly reduced in the incident direction of the electron beam, the X-ray detector 400 that is disposed with the target unit 30 between the X-ray detector and the electron beam emission unit 10 may detect a characteristic X-ray without interference from the generated Bremsstrahlung X-rays. It is noted, since the X-ray detector 400 detects the characteristic X-ray that is discharged from the target unit 30 while passing through the target unit 30, the electron beam emission unit 10 does not necessarily include an opening.

As described above, the X-ray detector 400 is disposed in a region or arranged, relative to the other X-ray components, where the characteristic X-ray may be detected easily without interference from the generated Bremsstrahlung X-rays, and thus, the X-ray photographing apparatus 1000 may not include or require a filter for removing the Bremsstrahlung X-rays, or may include a minimal filter for removing any Bremsstrahlung X-rays which may be directed toward the X-ray detector 400. In addition, since the data is analyzed by using the characteristic X-ray, an X-ray image having high clarity and high contrast may be obtained, since the negative effects of interference from the generated Bremsstrahlung X-rays on the imaging process is reduced and/or eliminated.

According to the X-ray generator of the present invention, a large amount of electron beams may be condensed and incident into the target unit 30, and thus, a large amount of characteristic X-rays may be generated.

In addition, since the X-ray detector 400 is disposed in parallel with the X-ray generator 100 along the x-axis in the incident direction; that is, the travel direction of the electron beams, the X-ray detector 400 may detect the characteristic X-rays easily, and unnecessary exposure of the object to the X-rays may be greatly reduced.

In addition, since the X-ray image is obtained by detecting the characteristic X-ray without interference from the generated Bremsstrahlung X-rays, the contrast of the image is high enough to distinguish the materials or to perform the diagnosis. Furthermore, by focusing the electron beams and the subsequent generation of characteristic X-rays while minimizing the radiation to the object from the generated Bremsstrahlung X-rays, the amount of exposure of the object, such as a human patient, to doses of X-rays is minimized, to improve the safety of the X-ray photographing process for the patients.

The above-described apparatus and methods according to the present invention can be implemented in hardware, firmware or as software or computer code that can be stored in a recording medium such as a CD ROM, a RAM, a floppy disk, a hard disk, or a magneto-optical disk or computer code downloaded over a network originally stored on a remote recording medium or a non-transitory machine readable medium and to be stored on a local recording medium, so that the methods described herein can be rendered in such software that is stored on the recording medium using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An X-ray generator comprising:

a ring-shaped electron beam emission unit that emits electron beams;

an electron beam guide unit for condensing the electron beams and causing the condensed electron beams to travel in a predetermined direction, the electron beam guide unit being tubular, with at least a portion shaped substantially as a truncated cone, and having a proximal end and a distal end, the distal end being at a larger diameter end of the truncated cone; and a target unit having a target area facing the proximal end of the electron beam guide unit, for receiving the condensed electron beams and discharging X-rays via collision of the condensed electron beams with the target area;

wherein the discharged X-rays are emitted through a central opening of the electron beam guide unit's distal end.

2. The X-ray generator of claim 1, wherein the target area has a surface disposed perpendicularly to a travel direction of the condensed electron beams.

3. The X-ray generator of claim 1, wherein the electron beam guide unit comprises:

an electron beam collecting unit, in which the electron beam emission unit is disposed, for collecting the electron beams emitted from the electron beam emission unit;

an electron beam condensing unit for condensing the electron beams; and an electron beam incident unit for causing the condensed electron beams to be incident upon the target unit.

4. The X-ray generator of claim 3, wherein the electron beam collecting unit, the electron beam condensing unit, and the electron beam incident unit are sequentially arranged from the distal end of the electron beam emission unit toward a surface of the target unit.

5. The X-ray generator of claim 3, wherein at least one of the electron beam collecting unit, the electron beam condensing unit, and the electron beam incident unit is a separate component relative to the other components.

6. The X-ray generator of claim 3, wherein a cross-sectional perimeter region of the electron beam collecting unit is greater than a cross-sectional perimeter region of the electron beam incident unit.

7. The X-ray generator of claim 3, wherein a cross-sectional perimeter region of the electron beam condensing unit is reduced gradually from a side of the electron beam collecting unit to a side of the electron beam incident unit.

8. The X-ray generator of claim 1, wherein the electron beam guide unit comprises:

a first portion shaped substantially as the truncated cone, the truncated cone comprising a first end having the larger diameter at the distal end of the electron beam guide unit, and a second end having a smaller diameter at the proximal end of the electron beam guide unit; and a second portion in the shape of a hollow cylinder with substantially the same diameter as the second end of the truncated cone, and disposed between the second end and the target unit, the second portion being shorter in length than the first portion along an axis of the electron beam guide unit.

9. The X-ray generator of claim 3, wherein different respective voltages are applied to the electron beam collecting unit, the electron beam condensing unit, and the electron beam incident unit.

10. The X-ray generator of claim 9, wherein the voltage applied to the electron beam incident unit is greater than the voltages applied to the electron beam collecting unit and the electron beam condensing unit.

11. The X-ray generator of claim 1, wherein the electron beam emission unit is a ring shaped filament forming a central opening.

12. The X-ray generator of claim 1, wherein the target unit is rotatable.

13. The X-ray generator of claim 1, wherein the target unit discharges a plurality of characteristic X-rays having different spectrums from each other.

14. The X-ray generator of claim 13, wherein the plurality of characteristic X-rays are sequentially discharged one by one.

15. The X-ray generator of claim 1, wherein the target unit comprises a plurality of target areas that are formed of different materials from each other, and further comprises:

a target holder supporting the target unit and movable so that the plurality of target areas are selectively positioned in the travel direction of the electron beam.

16. The X-ray generator of claim 5, wherein the plurality of target areas are arranged in a circle on the target holder.

17. An X-ray photographing apparatus comprising:

an X-ray generator; and an X-ray detector for detecting X-rays discharged from the X-ray generator through an object;

wherein the X-ray generator comprises:

a ring-shaped electron beam emission unit that emits electron beams;

an electron beam guide unit for condensing the electron beams and causing the condensed electron beams to travel in a predetermined direction, the electron beam guide unit being tubular, with at least a portion shaped substantially as a truncated cone, and having a proximal end and a distal end, the distal end being at a larger diameter end of the truncated cone; and a target unit having a target area facing the proximal end of the electron beam guide unit, for receiving the condensed electron beams and discharging X-rays via collision of the condensed electron beams with the target area;

wherein the discharged X-rays are emitted through a central opening of the electron beam guide unit's distal end.

18. The X-ray photographing apparatus of claim 17, wherein the X-ray detector is disposed on the same line as a travel direction of the electron beam that is incident upon the target unit.

19. The X-ray photographing apparatus of claim 17, wherein the electron beam emission unit is disposed between the target unit and the X-ray detector.

20. The X-ray photographing apparatus of claim 17, wherein the X-ray detector detects characteristic X-rays.

21. An X-ray generator comprising:

a ring-shaped electron beam emission unit that emits electron beams;

an electron beam guide unit, for condensing the electron beams and causing the condensed electron beams to travel in a predetermined direction; and a target unit having a target area facing the electron beam guide unit, for receiving the condensed electron beams and discharging X-rays via collision of the condensed electron beams with the target area;

wherein the electron beam guide unit comprises:

a first portion in a configuration of a truncated cone with a proximal end and a distal end, the distal end having a larger diameter than the proximal end, and a second portion in the shape of a hollow cylinder with substantially the same diameter as the proximal end of the truncated cone, and disposed between the proximal end of the truncated cone and the target unit, the second portion being shorter in length than the first portion along an axis of the electron beam guide unit.

22. The X-ray generator of claim 21, further comprising, in combination, an X-ray detector to detect X-rays discharged from the X-ray generator through an object, wherein the target unit is disposed between the electron beam guide and the X-ray detector.

23. The X-ray generator of claim 1, wherein the electron beam emission unit is annularly disposed within the distal end.

24. The X-ray photographing apparatus of claim 18, wherein the electron beam emission unit is annularly disposed within the distal end.

25. The X-ray generator of claim 21, wherein the electron beam emission unit is annularly disposed within the distal end.

* * * * *

UNITED STATES PATENT AND TRADEMARK OFFICE

CERTIFICATE OF CORRECTION

PATENT NO. : 9,070,528 B2
APPLICATION NO. : 13/463351
DATED : June 30, 2015
INVENTOR(S) : Ki-yeo Kim et al.

It is certified that error appears in the above-identified patent and that said Letters Patent is hereby corrected as shown below:

On the Title Page:

Item 75, 3rd Inventor should read as follows:
--...Byung-sun Choi, Gyeonggi-do (KR)...--

In the Claims:

Column 12, Claim 16, Line 41 should read as follows:
--...claim 15, wherein the...--

Signed and Sealed this
Twentieth Day of October, 2015

Michelle K. Lee

Michelle K. Lee
*Director of the United States Patent and Trademark Office*